US007097243B2

(12) United States Patent
Verbovszky

(10) Patent No.: US 7,097,243 B2
(45) Date of Patent: Aug. 29, 2006

(54) CHILD'S CAR SEAT CUSHION

(76) Inventor: Esther A. L. Verbovszky, 325 N. Falmouth Dr., Rocky River, OH (US) 44116

( * ) Notice: Subject to any disclaimer, the term of this patent is extended or adjusted under 35 U.S.C. 154(b) by 0 days.

(21) Appl. No.: 10/360,496

(22) Filed: Feb. 6, 2003

(65) Prior Publication Data

US 2004/0155498 A1 Aug. 12, 2004

(51) Int. Cl.
*A47C 7/36* (2006.01)
*A47C 31/11* (2006.01)

(52) U.S. Cl. ..... 297/219.12; 297/393; 297/397; 5/655

(58) Field of Classification Search ..... 297/487, 297/488, 392, 393, 397, 219.12, 220; 5/655, 5/904, 425, 946
See application file for complete search history.

(56) References Cited

U.S. PATENT DOCUMENTS 4,383,713 A * 5/1983 Roston ..... 297/219.12 X
4,726,085 A * 2/1988 Antonio ..... 297/393 X
4,776,049 A * 10/1988 Perron ..... 297/393 X
4,892,357 A * 1/1990 Nieto-busby et al. ..... 297/219.12 X
5,056,533 A * 10/1991 Solano ..... 297/219.12 X
5,228,745 A * 7/1993 Hazel ..... 297/219.12 X
5,383,711 A * 1/1995 Houghteling ..... 297/397
5,586,351 A * 12/1996 Ive ..... 297/397 X
5,735,576 A * 4/1998 Pepys et al. ..... 297/397 X
5,826,287 A * 10/1998 Tandrup ..... 297/219.12 X
5,829,829 A * 11/1998 Celestina-krevh ..... 297/219.12
5,897,164 A * 4/1999 Kagan et al. ..... 297/219.12
5,979,981 A * 11/1999 Dunne et al. ..... 297/397 X
6,036,263 A * 3/2000 Gold ..... 297/397 X
6,139,100 A * 10/2000 Baskin-lockman et al. ..... 297/397 X
6,216,298 B1 * 4/2001 Oliveira ..... 297/393 X
6,266,832 B1 * 7/2001 Ezell ..... 297/397 X
6,341,818 B1 * 1/2002 Verbovszky et al. ... 297/219.12
6,363,558 B1 * 4/2002 Dunne ..... 5/655
6,386,639 B1 * 5/2002 McMichael ..... 297/393 X
6,467,840 B1 * 10/2002 Verbovszky et al. ... 297/219.12
6,523,901 B1 * 2/2003 Smith ..... 297/392
2002/0043859 A1 * 4/2002 Smith ..... 297/392
2003/0127899 A1 * 7/2003 Smith ..... 297/393 X

* cited by examiner

*Primary Examiner*—Rodney B White
(74) *Attorney, Agent, or Firm*—Tarolli, Sundheim, Covell & Tummino LLP

(57) ABSTRACT

A method of helping to secure an infant in a child's car seat and to prevent slouching of the infant in the car seat includes the step of placing a cushion having a unitary tube shaped structure into the car seat and placing an infant into the car seat where the tube-shaped structure has an upside-down U-shape including two legs with two axial ends and a base portion where the two legs are joined together. The base portion is located at the top of the back surface of the car seat and the two axial ends of the legs are located at the free edge of the seat surface of the car seat. The cushion legs engage the side walls of the car seat. The method includes the step of placing the infant into the car seat so that the infant is surrounded by the cushion base portion and legs to reduce the surface area of the car seat for the infant to occupy in order to help to minimize slouching of the infant in the car seat.

26 Claims, 4 Drawing Sheets

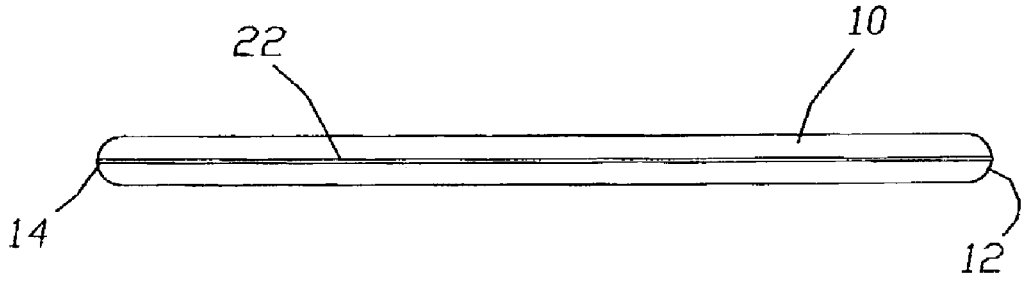
Fig. 9
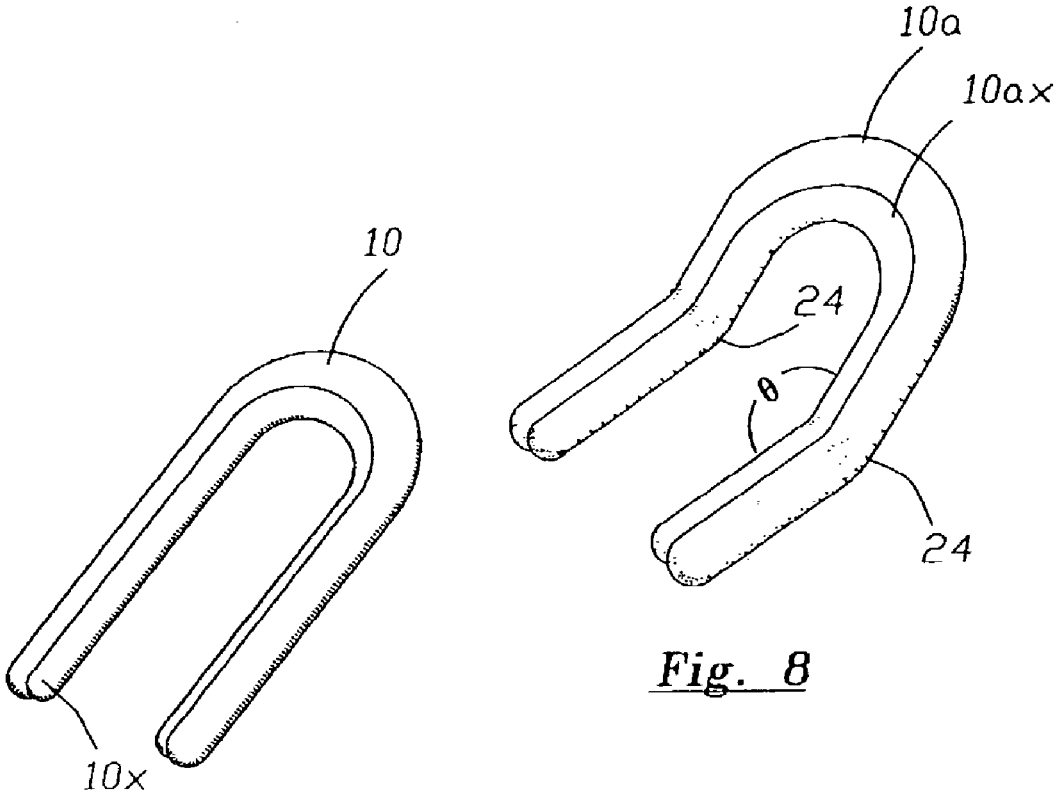
Fig. 8
Fig. 7

CHILD'S CAR SEAT CUSHION

TECHNICAL FIELD

The present invention relates, generally, to a method of protecting a child in a car seat and, to cushions for children's car seats to provide improved support and security for the child, especially for infants and newborns.

BACKGROUND OF THE INVENTION

Many states have laws requiring that children be restrained in a car seat while in an operating vehicle. Child car seat manufacturers have developed two different standard types and sizes of car seats to assure parents that not only are their children safe but that they are compliant with the state laws. The first standard type car seat is the infant carrier which is typically used with infants who weigh up to 20 pounds. The second standard type car seat is the front facing toddler support which is for toddlers who weigh from 20 pounds to 50 pounds. Unfortunately, the toddler support car seat due to its larger dimensions cannot accommodate newborns or very small infants, including premature infants and prematurely discharged newborns. The infant carrier, which is smaller than the toddler support, is also often too large to accommodate newborn or premature infants.

Infants who are too small to properly fit in a car seat can flop back and forth while in the car seat. Newborn or prematurely born infants, when placed into a car seat, are commonly forced into a seated orientation in which either the head is slumped or slouched or their entire bodies are slouched over since their bodies are not large enough to cover the surface area of the car seat. This not only affects the comfort of the child but also his or her safety and health.

Much of the surface area of the car seat between the body of the infant and the side walls of the car seat is left unoccupied. Even when the infant is secured by the safety belt which is part of the car seat structure, the infant is not supported at its lateral sides of its body and at its head and neck by the seat belt. The safety of the infant may be compromised in this situation.

Moreover, infants can be uncomfortable in such a slumped or slouched over orientation. A slumped or slouched over orientation can negatively affect the infant's breathing. Studies have shown that premature infants have significant decreases in oxygen saturation while restrained in a car seat with 30% experiencing hypoxia, bradycardia, sleep apnea or some combination of those conditions.

The decrease in oxygen saturation is directly related to the degree to which the infant is slumped or slouched over in the car seat; the more slumped or slouched over is the infant, the greater the physiological risk, the less slumped or slouched over is the infant, the lesser the physiological risk. This occurs because the more slumped or slouched over the infant is, either forward or sideways, the greater the risk of airway obstruction in the infant.

Infant slouching or slumping occurs for two basic reasons, low birth weight infants cannot resist the gravitational effects if their bodies are in a too upright position, and standard sized child car seats do not provide the necessary support and orientation for these infants to prevent the gravitational effects. These effects can cause slouching or slumping since most infants do not have the physical maturation or strength of the back to maintain an upright position.

Accordingly, there exists a need for a child's car seat cushion that helps to support the child in a physiologically and physically beneficial orientation when the child is too small for the car seat by minimizing or preventing the child from slouching or slumping. There also exists a need for a child's car seat cushion that helps to secure the child who is too small to fit in standard size car seats in such car seats in order to help protect the child from injury during a vehicle crash event or sudden vehicle movement.

SUMMARY OF THE INVENTION

The present invention provides a child's car seat cushion that satisfies the aforementioned needs. Accordingly, it is an object of the present invention to provide a cushion that inserts into any standard child's car seat.

It is another object of the present invention to provide a cushion that will support and help to secure a child, but especially newborns and infants while in a car seat.

It is yet another object of the present invention to provide a car seat cushion that supports the child on the lateral sides of the child's body such that the child is properly positioned and secured while in the car seat and the space between the child's body and head and the side walls of the car seat is reduced to a minimum or eliminated altogether to prevent slumping over or slouching over of the child while in the car seat.

It is yet another object of the present invention to provide a car seat cushion that is manufactured from cushioning media to provide comfort, support and security to the child while in the car seat.

Accordingly, the present invention relates to a child's car seat cushion placed into a car seat to secure a child who is too small for the car seat in a comfortable orientation and which also helps to protect the child from injury and helps to prevent airway obstruction due to a slumped or slouched over orientation.

A method of helping to secure an infant in a child's car seat and to prevent slouching of the infant in the car seat includes the step of placing a cushion having a unitary tube shaped structure into the car seat and placing an infant into the car seat where the tube-shaped structure has a U-shape including two legs with two axial ends and a base portion where the two legs are joined together. The base portion is located at the top of the back surface of the car seat and the two axial ends of the legs are located at the free edge of the seat surface of the car seat. The cushion legs engage the side walls of the car seat. The infant is placed into the car seat so that the infant is surrounded and engages the cushion base portion and legs to reduce the surface area of the car seat for the infant to occupy in order to help secure the infant in the car seat and to prevent slouching of the infant in the car seat.

BRIEF DESCRIPTION OF THE DRAWINGS

The foregoing and other features of the present invention will become apparent to those skilled in the art to which the present invention relates upon reading the following description with reference to the accompanying drawings, in which:

FIG. 7 is a view of two child's car seat cushions according to FIG. 2 placed side by side;

FIG. 8 is a view of two child's car seat cushions according to FIG. 3 placed side by side;

FIG. 9 is a view of the child's car seat cushion according to FIG. 2 in an elongated condition;

DETAILED DESCRIPTION OF THE INVENTION

Figure 1:
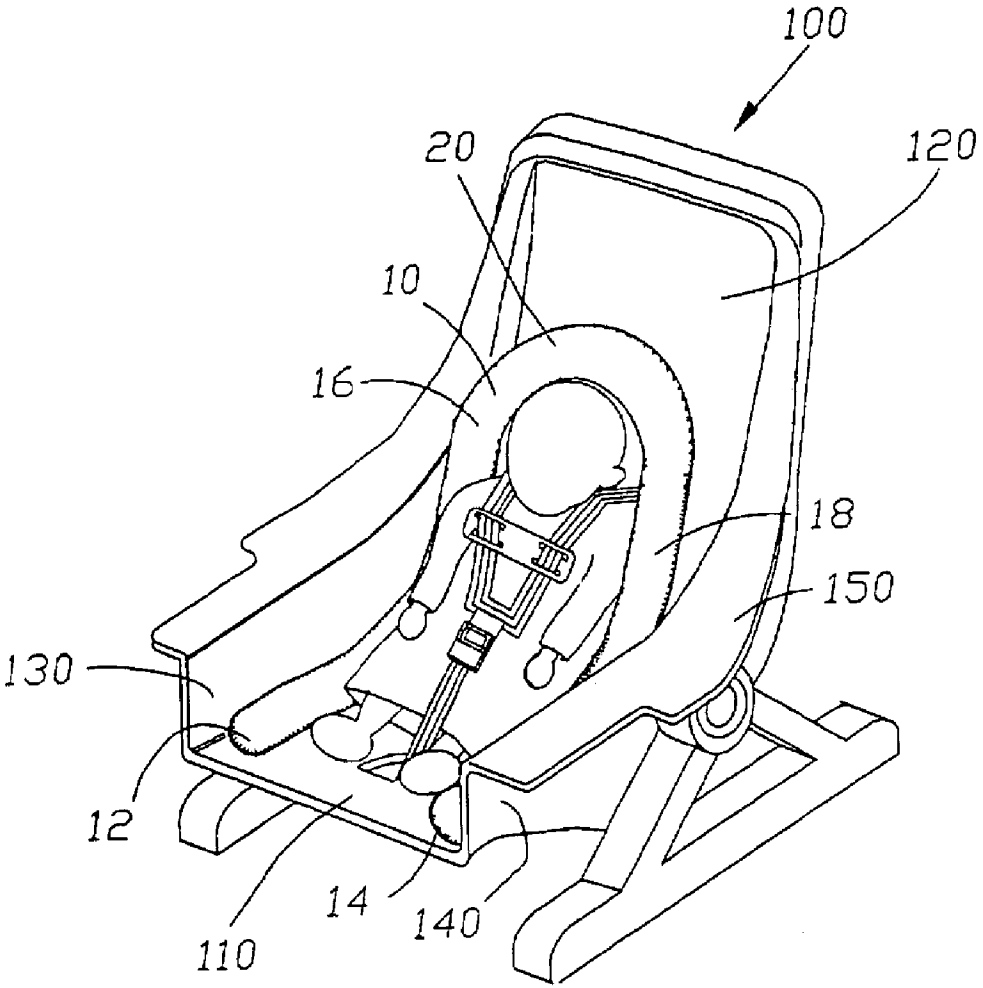
FIG. 1 is a perspective view of a child's car seat with a cushion according to the present invention shown inserted in a child's car seat with an infant.

The present invention is a child's car seat cushion 10 shown in FIG. 1 placed in a car seat 100 with an infant. The cushion 10 helps to secure and support the infant who does not fit into standard sized car seats. The car seat 100 is illustrated in a schematic view and can have any similar construction. The car seat 100 includes a seat surface 110 and a back surface 120 extending upwardly from the edge of the seat surface 100. The car seat 100 also includes two lateral side walls 130, 140 between which the seat surface 110 and the back surface 120 extend.

Figure 2:
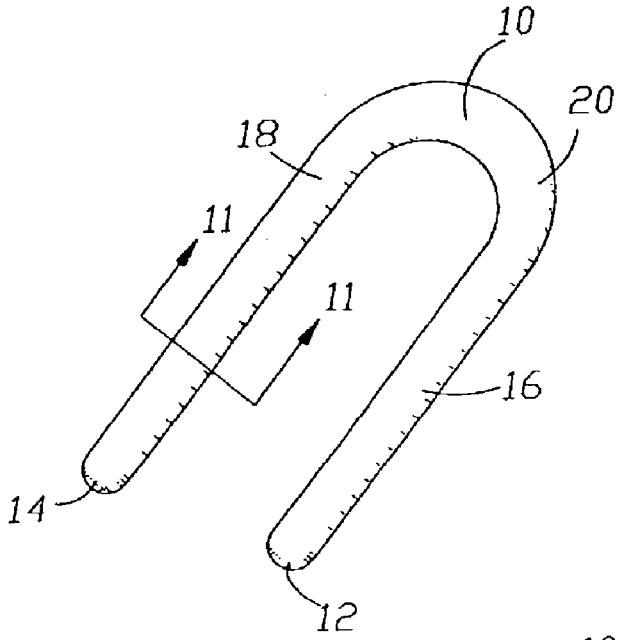
FIG. 2 is a perspective view of the child's car seat cushion according to the present invention shown in FIG. 1.

The cushion 10 is an elongate flexible, unitary tube-shaped structure with two axial ends 12, 14. (FIG. 9) For insertion into the car seat 100, the cushion 10 is manually bent at approximately the middle of its length to form an upside down "U" shape. (FIG. 2) The upside down U-shaped cushion 10 has two legs 16, 18 extending an approximately equal distance. The two legs 16, 18 extend from a base portion 20 where the two legs are joined together.

The cushion 10 is placed onto the car seat 100 (FIG. 1) adjacent the seat surface 110 and back surface 120 of the car seat so the base portion 20 of the cushion 10 is located at the top of the back surface of the car seat above the infant's head. The two axial ends 12, 14 of the upside down U-shaped cushion 10 are located at the free edge of the seat surface 110 of the car seat 100 where the infant's legs and/or feet are located when the infant is seated in the car seat.

The two legs 16, 18 of the cushion 10 are pushed into a recess 150 formed at the intersection of the seat surface 110 and back surface 120 of the car seat 100. The infant is located in the car seat 100 so that the head of the infant preferably contacts and is surrounded by the base portion 20 of the cushion 10 and the lateral sides of the body of the infant preferably contact the two legs 16, 18 of the cushion.

Figure 11:
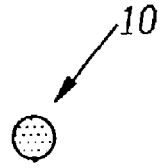
FIG. 11 is a cross-sectional view of the child's car seat cushion taken along section line 11—11 in FIG. 2.

The cushion 10 is preferably made of a tube of French terry cloth material filled with batting. (FIG. 11.) French terry cloth material consists of 80% cotton/20% polyester fiber. The batting is preferably a flame retardant 100% polyester material. Instead of French terry cloth, the material of the cushion 10 may be any suitable equivalent textile material such as cotton, polyester, wool, fleece, or a combination thereof. Instead of batting, the cushion 10 can be filled with foam or gel or other suitable material or can be inflated with water or air. Also, the batting may be of a suitable material other than polyester materials.

The cushion 10 is sewn together lengthwise along a seam 22. The seam 22 is preferably located on the underside of the cushion 10 when placed in the car seat 100. Instead of sewing, the material can be joined together by for example, a zipper, snaps, buttons, gluing or by a Velcro™ type hook-and-eye closure.

The material of the cushion 10 may alternately be made of a cushioning media such as a flame retardant foam rubber or foam vinyl covered with a suitable washable skin made of hypoallergenic plastic, nylon, polyurethane or any suitable material. The cushioning media may have skin manufactured with a nylon facing and a backing of a 65%/35% combination of polyester and cotton. The foam used in the manufacture of the cushion can also be a particular type of foam known as "memory foam". Memory foam temporarily retains the shape of an object which is pressed onto it. For example, memory foam can temporarily retain the body shape of an infant who is placed on the foam. The cushion 10 is washable. The cushion 10 reduces the surface area of the seat surface 110 and back surface 120 on the car seat 100 on which the infant is placed and provides an additional wall of cushion material.

Figure 10:
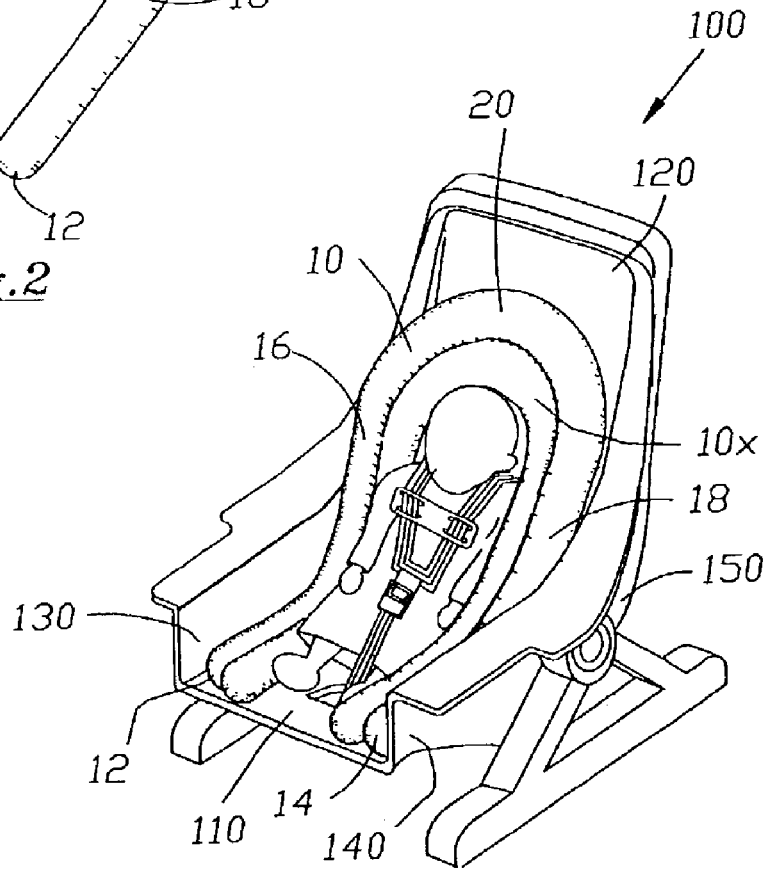
FIG. 10 is a view identical to FIG. 1 except two child's car seat cushions according to FIG. 2 are shown inserted side by side in a child's car seat with an infant.

As can be seen in FIGS. 7 and 10, a second cushion 10*x* can also be placed in the car seat 100 on the inside of the cushion 10. The second cushion 10*x* is identical to the cushion 10 except that the second cushion 10*x* is smaller in thickness and in length than the cushion 10. The second cushion 10*x* can also be the same size as the cushion 10. The second cushion 10*x* is be placed side by side next to the cushion 10 in the car seat 100 when the infant is very small in size, for example, when the infant is a new born or a premature infant and does not properly fit into the car seat 100. Similarly, when the infant grows to a larger size, the second cushion 10*x* is removed from the car seat, leaving only the cushion 10 which increases the surface area of the car seat upon which the infant can lie.

In the embodiment according to FIG. 9, the cushion 10 is approximately 56 inches in length. The diameter of a cross-section of the cushion 10 is approximately 4 inches. (FIG. 11) It is to be understood that the cushion 10 can have various dimensions according to the desire of the manufacturer. For example, the cushion 10 can range in diameter from approximately 1–6 inches. Also, the length of the cushion 10 can range from approximately 40–90 inches.

Figure 3:
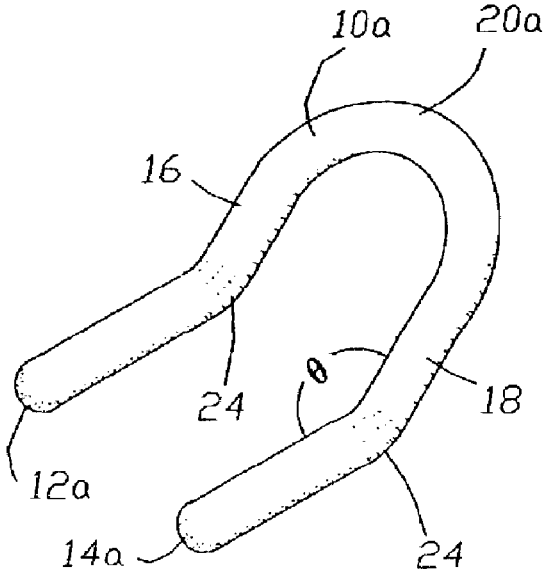
FIG. 3 is a perspective view of a second embodiment of the child's car seat cushion according to the present invention.

FIG. 3 illustrates a second embodiment of the invention. The cushion 10*a* is similar to the cushion 10 shown in FIGS. 1–2, and parts that are the same or similar are given the same reference numerals with the suffix "a" attached. In this embodiment, the cushion 10*a* is pre-formed into an upside down U-shape and includes an pre-formed elbow shaped bend 24 in each of the legs 16*a*, 18*a* at a location which is at approximately half of the length of the legs. The pre-formed angle θ of the bend is approximately 105° before insertion into the car seat 100. 105° is approximately equal to the standard cradle angle formed by the intersection of the seat surface 110 and back surface 120 of the car seat 100. (FIG. 1).

Although the cushion 10*a* is pre-formed, the cushion is also flexible. The cushion 10*a* is preformed by cutting out a fabric pattern which includes the shape of the bend 24, sewing the fabric together and stuffing the cushion with batting.

Although the cushion 10*a* is not shown placed into a car seat, the placement of cushion 10*a* is similar to the placement of the cushion 10 according to FIG. 1. When the cushion 10*a* (FIG. 3) is placed in the car seat 100, the location of the elbow shaped bend 24 is aligned over the recess 150 in the car seat. The cushion 10*a* conforms to the contours of the car seat 100 and the bend angle θ conforms to the standard cradle angle of the car seat.

The pre-formed upside down U-shaped cushion 10*a* with elbow bend 24 eliminates the steps of bending the cushion into an upside-down U-shape before insertion into the car seat 100 and eliminates the step of pushing the legs 16*a*, 18*a* into the recess 150 formed at the intersection of the seat surface 110 and back surface 120 of the car seat.

A second cushion 10*ax* can also be placed in the car seat 100 on the inside of the cushion 10*a*. (FIG. 8). The second cushion 10*ax* is identical to the cushion 10. The second cushion 10*ax* can also be smaller in length and thickness than the cushion 10*a*. The second cushion 10*ax* can be placed side by side next to the cushion 10*a* in the car seat 100 when the infant is very small in size, for example, when the infant is a new born or a premature infant and does not properly fit into the car seat 100. Similarly, when the infant grows to a larger size, the second cushion 10*ax* is removed from the car seat, leaving only the cushion 10*a* which increases the surface area of the car seat upon which the infant can lie.

It is to be understood that the standard cradle angle of the schematically illustrated car seat is only an approximation. If the standard cradle angle is different than the 105° illustrated herein, the preformed bend angle θ of the cushion 10*a* can also be modified from 105° to match approximately to the standard cradle angle without departing from the scope of the invention. For example, car seat cradle angles may vary according to manufacture in extreme cases from between 90°–135°. Therefore, the cushion 10*a* can also have a bend angle θ from between 90°–135°.

Figure 4:
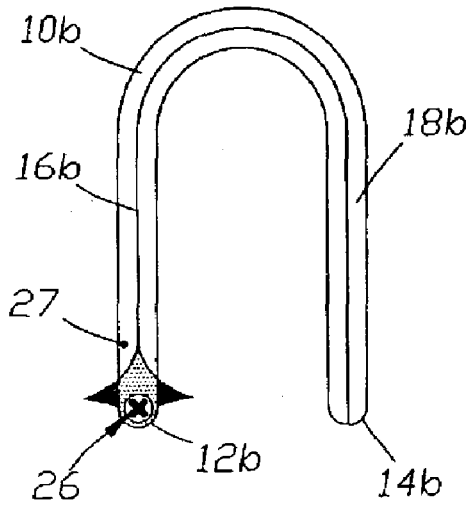
FIG. 4 is a partial cross-sectional view of a third embodiment of the child's car seat cushion according to the present invention.

FIG. 4 illustrates a third embodiment of the invention. The cushion 10*b* is similar to the cushion 10 FIGS. 1–2, and parts that are the same or similar are given the same reference numerals with the suffix "b" attached. In this embodiment, the cushion 10*b* includes an audible sound producing device, namely a battery operated music box 26, located in the axial end 12*b* of the leg 16*b*. The music box 26 plays chime lullabies or similar music. The music box 26 is activated by a care giver manually depressing a button 27 sewn onto the outside of the material of the leg 16*b*. Optionally, the button 27 can be depressed so easily that the infant's leg can activate the music box if it kicks the button when the infant is placed into the car seat 100. The music box 26 can also be self-activating. A self-activating music box 26 has no depressible buttons and activates instead in response to an impact force exceeding a predetermined impact force threshold, such as in response to the infant kicking the leg 16*b* of the cushion 10*b*. Alternately, the music box 26 can be located in the opposite axial end 14*b* of the other leg 18*b* or a music box may be located in each axial end of the cushion 10*b*. The music box 26 is only schematically illustrated since many different configurations of music boxes can be employed.

The music box 26 is insulated by the batting or other cushioning media in the cushion 10*b* so that the infant cannot accidentally hurt his or her leg by a sudden movement into the cushion into area where the music box is located. On the other hand, the music box 26 is loud enough to be heard by the infant through the insulation. Preferably, the axial end 12*b* of the leg 16*b* can be opened to remove the music box 26 in order to change batteries or to wash the cushion 10*b*.

The opening in the axial end 12*b* is releasably closed by, for example, a zipper, snaps, buttons or a Velcro™ type hook-and-eye closure. Alternatively, the music box 26 can also be permanently fixed inside the cushion 10*b* in that the cushion has no opening. The music box 26 can also have a waterproof structure.

Figure 5:
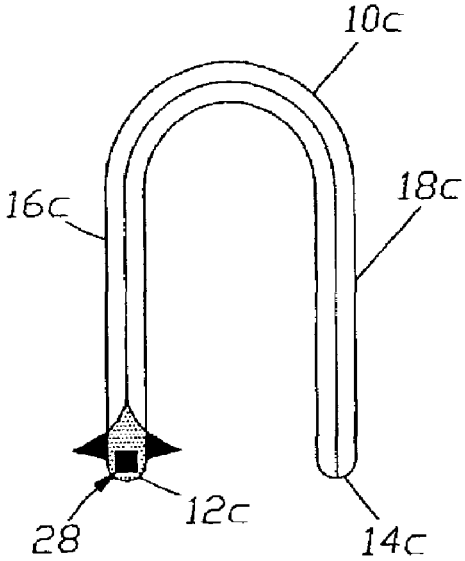
FIG. 5 is a partial cross-sectional view of a fourth embodiment of the child's car seat cushion according to the present invention.

FIG. 5 illustrates a fourth embodiment of the invention. The cushion 10*c* is similar to the cushion 10 FIGS. 1–2, and parts that are the same or similar are given the same reference numerals with the suffix "c" attached. In this embodiment, instead of the music box 26, the cushion 10*c* includes a rattle 28. The rattle 28 is located in the axial end 12*c* of the leg 16*c* of the cushion 10*c*. Alternatively, the rattle 28 may be located in the opposite axial end 14*c* of the leg 18*c* or a rattle may be located in each axial end of the cushion 10*c*. The rattle 28 is only schematically illustrated as many different configurations of rattles may be employed.

The rattle 28 is a waterproof plastic structure containing small beads which make an audible rattling sound when shaken or suddenly jarred such as when the leg of the infant kicks the cushion 10*c* where the rattle is located. Like the music box 26, the rattle 28 is also insulated by the batting or other cushioning media to prevent injury to the infant upon the infant suddenly kicking the cushion 10*c*. On the other hand, the rattle 28 is loud enough to be heard by the infant through the insulation.

Figure 6:
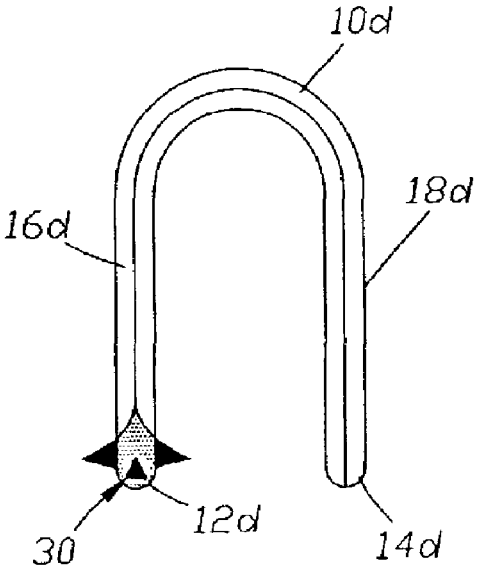
FIG. 6 is a partial cross-sectional view of a fifth embodiment of the child's car seat cushion according to the present invention.

FIG. 6 illustrates a fifth embodiment of the invention. The cushion 10*d* is similar to the cushion 10 FIG. 1–2, and parts that are the same or similar are given the same reference numerals with the suffix "d" attached. In this embodiment, instead of the music box 26 or rattle 28, the cushion 10*d* includes jingle bells 30 which are only schematically illustrated in FIG. 6.

The jingle bells 30 make an audible jingling sound when moved. The jingle bells 30 are located in the leg of the cushion in a waterproof plastic container or other container. The waterproof container permits washing of the cushion 10*d* without water contacting the jingle bells 30 to prevent the jingle bells from rusting. The jingle bells 30 can each be located in either or both axial ends of the cushion 10*d*.

The cushion 10 (FIG. 1) advantageously reduces the space available on the seat surface 110 and back surface 120 of the car seat 100 for placement of an infant. The cushion 10 prevents slouching or slumping over of an infant and helps to better secure the infant in the case of a vehicle crash event than the car seat 100 by itself without the cushion. Also, as illustrated in FIG. 10, if the second cushion 10*x* is inserted side by side next to the first cushion 10 into the car seat 100, the seat surface 110 and back surface 120 of the cushion is advantageously reduced even more to accommodate a smaller size infant.

Although the cushion 10 is shown for insertion into a car seat 100 in FIGS. 1–11, the infant cushion can be advantageously inserted horizontally in a crib (not shown) to provide a secure cushioned surrounding in which the infant cannot roll out of the confines of the cushion and into the crib slots. Instead of a crib, the infant cushion 10 can also be placed onto a bassinet, the floor, on top of an adult bed, into a stroller or baby buggy (not shown).

From the above description of the invention, those skilled in the art will perceive improvements, changes and modifications. For example, the infant can be placed into the car seat 100 either before the cushion 10 is placed into the car seat or after the cushion is placed into the car seat. The cushion 10 is flexible enough to allow adjustments to its position in the car seat 100 by a care giver with the infant already placed into the car seat before the cushion is placed into the car seat. Such improvements, changes and modifications within the skill of the art are intended to be covered by the appended claims.

Having described the invention, the following is claimed:

1. A cushion for helping to secure an infant in a child's seat and to prevent slouching of the infant in the child's seat, the child's seat comprising a seat surface and a back surface extending between two side walls, said cushion comprising:

a unitary preformed U-shaped structure having a base portion and two legs extending equidistant from said base portion, said two legs having axial ends, when placed into the child's seat, said base portion of said cushion being located at a top of the back surface and said axial ends of said legs being located at a free edge of the seat surface, and one or both of said axial ends containing an audible sound producing device, said cushion reducing the surface area for an infant to be placed in the child's seat to occupy in order to help secure the infant in the child's seat and to minimize slouching of the infant in the child's seat, wherein said audible sound producing device is one of a music box, a rattle and jingle bells, the music box being self-activating in response to an impact force exceeding a predetermined impact force threshold.

2. A method of helping to secure an infant in a child's seat and to prevent slouching of the infant in the child's seat, the child's seat comprising a seat surface and a back surface extending between two side walls, said method comprising the steps of:

providing a unitary cushion having an upside down U-shaped structure with a base portion which extends between two legs of the cushion, each of the cushion legs having a central portion with a bend formed therein, positioning the cushion in the child's seat, said step of positioning the cushion in the child's seat includes positioning the base portion of the cushion in engagement with the back surface of the child's seat, said step of positioning the cushion in the child's seat includes positioning a first one of the cushion legs along and in engagement with a first one of the side walls of the child's seat, said step of positioning a first one of the cushion legs includes positioning a portion of the first one of the cushion legs disposed between the bend in the first one of the cushion legs and the base portion of the cushion in engagement with the back surface of the child's seat and positioning a portion of the first one of the cushion legs disposed between the bend in the first one of the cushion legs and an axial end portion of the first one of the cushion legs in engagement with the seat surface of the child's seat, said step of positioning the cushion in the child's seat includes positioning a second one of the cushion legs extending from the base portion of the cushion along and in engagement with a second one of the side walls of the child's seat, said step of positioning a second one of the cushion legs includes positioning a portion of the second one of the cushion legs disposed between the bend in the second one of the cushion legs and the base portion of the cushion in engagement with the back surface of the child's seat and positioning a portion of the second one of the cushion legs disposed between the bend in the second one of the cushion legs and an axial end portion of the second one of the cushion legs in engagement with the seat surface of the child's seat, and placing the infant into the child's seat with lateral sides and top of the head of the infant at least partially enclosed by the base portion of the cushion and with hips and legs of the infant at least partially disposed between the first and second cushion legs and with the hips of the infant adjacent to the bends in the first and second cushion legs to reduce surface area of the child's seat for the infant to occupy in order to help minimizing of slouching of the infant in the child's seat.

3. A method of helping to secure an infant in a child's seat and to prevent slouching of the infant in the child's seat, the child's seat comprising a seat surface and a back surface extending between two side walls, said method comprising the steps of:

providing a unitary cushion having an upside down U-shaped structure with a base portion which extends between two legs of the cushion, each of the cushion legs having a central portion with a bend formed therein, positioning the cushion in the child's seat, said step of positioning the cushion in the child's seat includes positioning the base portion of the cushion in engagement with the back surface of the child's seat, said step of positioning the cushion in the child's seat includes positioning a first one of the cushion legs along and in engagement with a first one of the side walls of the child's seat, said step of positioning a first one of the cushion legs includes positioning a portion of the first one of the cushion legs disposed between the bend in the first one of the cushion legs and the base portion of the cushion in engagement with the back surface of the child's seat and positioning a portion of the first one of the cushion legs disposed between the bend in the first one of the cushion legs and an axial end portion of the first one of the cushion legs in engagement with the seat surface of the child's seat, said step of positioning the cushion in the child's seat includes positioning a second one of the cushion legs extending from the base portion of the cushion along and in engagement with a second one of the side walls of the child's seat, said step of positioning a second one of the cushion legs includes positioning a portion of the second one of the cushion legs disposed between the bend in the second one of the cushion legs and the base portion of the cushion in engagement with the back surface of the child's seat and positioning a portion of the second one of the cushion legs disposed between the bend in the second one of the cushion legs and an axial end portion of the second one of the cushion legs in engagement with the seat surface of the child's seat, placing the infant into the child's seat with lateral sides and top of the head of the infant at least partially enclosed by the base portion of the cushion and with hips and legs of the infant at least partially disposed between the first and second cushion legs and with the hips of the infant adjacent to the bends in the first and second cushion legs to reduce surface area of the child's seat for the infant to occupy in order to help minimizing of slouching of the infant in the child's seat, providing a second unitary cushion having an upside down U-shaped structure with a base portion which extends between two legs of the second cushion, each of the legs of the second cushion having a central portion with a bend formed therein, positioning the second cushion in the child's seat, said step of positioning the second cushion in the child's seat includes positioning the base portion of the second cushion in engagement with the back surface of the child's seat, said step of positioning the second cushion in the child's seat includes positioning a first one of the second cushion legs extending from the base portion of the second cushion along the first one of the side walls of the child's seat, said step of positioning a first one of the second cushion legs includes positioning a portion of the first one of the second cushion legs disposed between the bend in the first one of the second cushion legs and the base portion of the second cushion in engagement with the back surface of the child's seat and positioning a portion of the first one of the second cushion legs disposed between the bend in the first one of the second cushion legs and an axial end portion of the first one of the second cushion legs in engagement with the seat surface of the child's seat, said step of positioning the second cushion in the child's seat includes positioning a second one of the second cushion legs extending from the base portion of the second cushion along the second one of the side walls of the child's seat, said step of positioning a second one of the second cushion legs includes positioning a portion of the second one of the second cushion legs disposed between the bend in the second one of the second cushion legs and the base portion of the second cushion in engagement with the back surface of the child's seat and positioning a portion of the second one of the second cushion legs disposed between the bend in the second one of the second cushion legs and an axial end portion of the second one of the second cushion legs in engagement with the seat surface of the child's seat.

4. A method as set forth in claim 3 wherein said step of placing the infant into the child's seat includes placing the infant into the child's seat with the lateral sides and top of the head of the infant at least partially enclosed by the base portion of the second cushion and with hips and legs of the infant at least partially disposed between the first and second legs of the second cushion and with the hips of the infant adjacent to the bends in the first and second legs of the second cushion.

5. A method as set forth in claim 2 wherein said step of providing a cushion having an upside down U-shaped structure includes bending the cushion to form the base portion of the cushion into an arcuate configuration.

6. A method as set forth in claim 2 wherein said step of positioning the cushion in the child's seat includes moving the bends in the first and second legs of the cushion along the side walls of the child's seat into a recess formed at an intersection of the seat surface and back surface of the child's seat.

7. An apparatus comprising:

a child's seat having first and second side walls with a seat surface extending between said first and second side walls and a back surface extending between said first and second side walls, and a unitary cushion having an upside down U-shaped structure with a base portion which extends between two legs of said cushion, each of said cushion legs having a central portion with a bend formed therein, said base portion of said cushion being disposed in engagement with said back surface of said child's seat, said base portion of said cushion being adopted to at least partially enclose lateral sides and top of a head of an infant disposed in the child's seat, said first leg of said cushion having a first portion which extends between the bend in said first leg of said cushion and said base portion of said cushion, said first portion of said first leg of said cushion is at least partially disposed in engagement with said back surface and said first side wall of said child's seat, said first leg of said cushion having a second portion which extends between the bend in said first leg of said cushion and an axial end portion of said first leg of said cushion, said second portion of said first leg of said cushion is at least partially disposed in engagement with said seat surface and said first side wall of said child's seat, said second leg of said cushion having a first portion which extends between the bend in said second leg of said cushion and said base portion of said cushion, said first portion of said second leg of said cushion is at least partially disposed in engagement with said back surface and said second side wall of said child's seat, said second leg of said cushion having a second portion which extends between the bend in said second leg of said cushion and an axial end portion of said second leg of said cushion, said second portion of said second cushion is at least partially disposed in engagement with said seat surface and said second side wall of said child's seat, said bends in said first and second legs of said cushion being disposed adjacent to hips of the infant disposed in the child's seat.

8. An apparatus comprising:

a child's seat having first and second side walls with a seat surface extending between said first and second side walls and a back surface extending between said first and second side walls, a unitary cushion having an upside down U-shaped structure with a base portion which extends between two legs of said cushion, each of said cushion legs having a central portion with a bend formed therein, said base portion of said cushion being disposed in engagement with said back surface of said child's seat, said base portion of said cushion being adopted to at least partially enclose lateral sides and top of a head of an infant disposed in the child's seat, said first leg of said cushion having a first portion which extends between the bend in said first leg of said cushion and said base portion of said cushion, said first portion of said first leg of said cushion is at least partially disposed in engagement with said back surface and said first side wall of said child's seat, said first leg of said cushion having a second portion which extends between the bend in said first leg of said cushion and an axial end portion of said first leg of said cushion, said second portion of said first leg of said cushion is at least partially disposed in engagement with said seat surface and said first side wall of said child's seat, said second leg of said cushion having a first portion which extends between the bend in said second leg of said cushion and said base portion of said cushion, said first portion of said second leg of said cushion is at least partially disposed in engagement with said back surface and said second side wall of said child's seat, said second leg of said cushion having a second portion which extends between the bend in said second leg of said cushion and an axial end portion of said second leg of said cushion, said second portion of said second cushion is at least partially disposed in engagement with said seat surface and said second side wall of said child's seat, said bends in said first and second legs of said cushion being disposed adjacent to hips of the infant disposed in the child's seat, a second unitary cushion having an upside down U-shaped structure with a base portion which extends between two legs of said second cushion, each of said legs of said second cushion having a central portion with a bend formed therein, said base portion of said second cushion being disposed in engagement with said back surface of said child's seat said base portion of said second cushion being adapted to at least partially enclose lateral sides and top of a head of the infant disposed in the child's seat, said first leg of said second cushion having a first portion which extends between the bend in the first leg of said second cushion and said base portion of said second cushion, said first portion of said first leg of said second cushion is at least partially disposed in engagement with said back surface of said child's seat, said first leg of said second cushion having a second portion which extends between the bend in said first leg of said second cushion and an axial end portion of said first leg of said second cushion, said second portion of said first leg of said second cushion is at least partially disposed in engagement with said seat surface of said child's seat, said second leg of said second cushion having a first portion which extends between the bend in said second leg of said second cushion and said base portion of said second cushion, said first portion of said second leg of said second cushion is at least partially disposed in engagement with said back surface of said child's seat, said second leg of said second cushion having a second portion which extends between the bend in said second leg of said second cushion and an axial end portion of said second leg of said second cushion, said second portion of said second leg of said second cushion is at least partially disposed in engagement with said seat surface of said child's seat, said bends in said first and second legs of said second cushion being disposed adjacent to the hips of the infant disposed in the child's seat.

9. An apparatus as set forth in claim 8 wherein said first leg of said second cushion and said second leg of said second cushion extend generally parallel to each other so that the infant can be positioned in a space disposed between said first and second legs of said second cushion with hips and legs of the infant between the first and second legs of said second cushion.

10. An apparatus as set forth in claim 7 wherein the bends in said first and second legs of said cushion are disposed in a recess formed at an intersection of said seat surface and said back surface of said child's seat.

11. An apparatus as set forth in claim 7 wherein said bends in said first and second legs of said cushion having an angle of between 90° and 135°.

12. An apparatus as set forth in claim 7 further including a device which is capable of producing an audible sound, said device being disposed in said axial end portion of said first leg of said cushion.

13. An apparatus comprising:

a child's seat having first and second side walls with a seat surface extending between said first and second side walls and a back surface extending between said first and second side walls, a unitary cushion having an upside down U-shaped structure with a base portion which extends between two legs of said cushion, each of said cushion legs having a central portion with a bend formed therein, said base portion of said cushion being disposed in engagement with said back surface of said child's seat, said base portion of said cushion being adopted to at least partially enclose lateral sides and top of a head of an infant disposed in the child's seat, said first leg of said cushion having a first portion which extends between the bend in said first leg of said cushion and said base portion of said cushion, said first portion of said first leg of said cushion is at least partially disposed in engagement with said back surface and said first side wall of said child's seat, said first leg of said cushion having a second portion which extends between the bend in said first leg of said cushion and an axial end portion of said first leg of said cushion, said second portion of said first leg of said cushion is at least partially disposed in engagement with said seat surface and said first side wall of said child's seat, said second leg of said cushion having a first portion which extends between the bend in said second leg of said cushion and said base portion of said cushion, said first portion of said second leg of said cushion is at least partially disposed in engagement with said back surface and said second side wall of said child's seat, said second leg of said cushion having a second portion which extends between the bend in said second leg of said cushion and an axial end portion of said second leg of said cushion, said second portion of said second cushion is at least partially disposed in engagement with said seat surface and said second side wall of said child's seat, said bends in said first and second legs of said cushion being disposed adjacent to hips of the infant disposed in the child's seat, wherein said cushion is at least partially formed of a memory foam which retains a shape to which it is deflected.

14. A method of helping to secure an infant in a child's seat and to prevent slouching of the infant in the child's seat, the child's seat comprising a seat surface and a back surface extending between two side walls, said method comprising the steps of providing a first unitary cushion having an upside down U-shaped structure with a base portion which extends between two legs of the first cushion, providing a second unitary cushion having an upside down U-shaped structure with a base portion which extends between two legs of the second cushion, positioning the first cushion in the child's seat, said step of positioning the first cushion in the child's seat includes positioning the base portion of the first cushion in engagement with the back surface of the child's seat, said step of positioning the first cushion in the child's seat includes positioning a first one of the legs of the first cushion along and in engagement with a first one of the side walls of the child's seat, said step of positioning the first cushion in the child's seat includes positioning a second one of the legs of the first cushion along and in engagement with a second one of the side walls of the child's seat, positioning the second cushion in the child's seat, said step of positioning the second cushion in the child's seat includes positioning the base portion of the second cushion in engagement with the base portion of the first cushion, said step of positioning the second cushion in the child's seat includes positioning a first one of the legs of the second cushion in engagement with the first one of the legs of the first cushion, said step of positioning the second cushion in the child's seat includes positioning a second one of the legs of the second cushion in engagement with the second one of the legs of the first cushion, and placing the infant into the child's seat with lateral sides and top of the head of the infant at least partially enclosed by the base portion of the second cushion and with hips and legs of the infant at least partially disposed between the first and second legs of the second cushion to reduce surface area of the child's seat for the infant to occupy in order to help minimizing of slouching of the infant in the child's seat.

15. A method as set forth in claim 14 wherein said step of positioning the first cushion in the child's seat includes positioning the first one of the legs of the first cushion in engagement with the back surface and in engagement with the seat surface of the child's seat and positioning the second one of the legs of the first cushion in engagement with the back surface and in engagement with the seat surface of the child's seat, said step of positioning the second cushion in the child's seat includes positioning the base portion of the second cushion in engagement with the back surface of the child's seat, positioning the first one of the legs of the second cushion in engagement with the back surface and in engagement with the seat surface of the child's seat, and positioning the second one of the legs of the second cushion in engagement with the back surface and in engagement with the seat surface of the child's seat.

16. A method as set forth in claim 14 wherein each of the legs of the first and second cushions have a central portion with a bend formed therein, said step of placing infant into the child's seat includes placing the infant in the child's seat with the hips of the infant adjacent to the bends in the legs of the first and second cushions.

17. A method as set forth in claim 14 wherein said step of providing a first cushion having an upside down U-shaped structure includes bending the first cushion to form the base portion of the first cushion into an arcuate configuration, said step of providing a second cushion having an upside down U-shaped structure includes bending the second cushion to form the base portion of the second cushion into an arcuate configuration.

18. A method as set forth in claim 14 wherein each of the legs of the first and second cushions have a central portion with a bend formed therein, said step of positioning the first one of the legs of the second cushion in engagement with the first one of the legs of the first cushion includes aligning the bend in the first one of the legs of the second cushion with the bend in the first one of the legs of the first cushion, said step of positioning the second one of the legs of the second cushion in engagement with the second one of the legs of the first cushion includes aligning the bend in the second one of the legs of the second cushion with the bend in the second one of the legs of the first cushion.

19. An apparatus comprising:

a child's seat having first and second side walls with a seat surface extending between said first and second side walls and a back surface extending between said first and second side walls, a first unitary cushion having an upside down U-shaped structure with a base portion which extends between two legs of said first cushion, said base portion of said first cushion being disposed in engagement with said back surface of said child's seat, a first one of said two legs of said first cushion extends along the first side wall of said child's seat, a second one of said two legs of said first cushion extends along the second side wall of the child's seat, providing a second unitary cushion having an upside down U-shaped structure with a base portion which extends between two legs of said second cushion, said base portion of said second cushion being disposed in engagement with said base portion of said first cushion, a first one of said two legs of said second cushion being disposed in engagement with said first leg of said first cushion, a second one of said two legs of said second cushion being disposed in engagement with said second leg of said first cushion, said base portion of said second cushion being adapted to at least partially enclose lateral sides and top of a head of an infant disposed in the child's seat, said first and second legs of said second cushion being adapted to at least partially enclose hips and legs of the infant, said first and second cushions cooperate to reduce surface area of the child's seat for the infant to occupy to help minimize slouching of the infant in the child's seat.

20. An apparatus as set forth in claim 19 wherein said first leg of said second cushion and said second leg of said second cushion extend generally parallel to each other so that an infant can be positioned in a space disposed between said first and second legs of said second cushion.

21. An apparatus as set forth in claim 19 further including a device which is capable of producing an audible sound, said device being disposed in an a first leg of one of said first and second cushions.

22. An apparatus as set forth in claim 19 wherein at least one of said first and second cushions is at least partially formed of a memory foam which retains a shape to which it is deflected.

23. An apparatus as set forth in claim 19 wherein said first leg of said second cushion has a first portion which extends between a bend in said first leg of said second cushion and said base portion of said second cushion, said first leg of said second cushion having a second portion which extends between the bend in said first leg of said second cushion and an axial end portion of said first leg of said second cushion, said second leg of said second cushion has a first portion which extends between a bend in said second leg of said second cushion and said base portion of said second cushion, said second leg of said second cushion has a second portion which extends between the bend in said second leg of said second cushion and an axial end portion of said second leg of said second cushion.

24. An apparatus as set forth in claim 23 wherein said first leg of said first cushion has a first portion which extends between a bend in said first leg of said first cushion and said base portion of said first cushion, said first leg of said first cushion has a second portion which extends between the bend in said first leg of said first cushion and an axial end portion of said first leg of said first cushion, said bend in said first leg of said first cushion being disposed adjacent to said bend in said first leg of said second cushion, said second leg of said first cushion has a first portion which extends between a bend in said second leg of said first cushion and said base portion of said first cushion, said second leg of said first cushion has a second portion which extends between the bend in said second leg of said first cushion and an axial end portion of said second leg of said first cushion, said bend in said second leg of said first cushion being disposed adjacent to said bend in said second leg of said second cushion.

25. A method of helping to secure an infant in a child's seat and to prevent slouching of the infant in the child's seat, the child's seat comprising a seat surface and a back surface extending between two side walls, said method comprising the steps of:

providing a unitary cushion having an upside down U-shaped structure with a base portion which extends between two legs of the cushion, each of the cushion legs having a central portion with a pre-shaped bend formed therein at a location which is approximately half of the length of the legs, each of the cushion legs having a first portion which extends between the bend and said base portion, said first portion is at least partially disposed in engagement with said back surface and one of said side walls of said child's seat, each of the cushion legs having a second portion which extends between the bend and an axial end portion of each of the cushion legs, said second portion extending in collinear alignment with said first portion at an angle between 90 degrees and 135 degrees, said second portion of each of said legs is at least partially disposed in engagement with said seat surface and one of said side walls of said child's seat, positioning the cushion in the child's seat, said step of positioning the cushion in the child's seat includes positioning the base portion of the cushion in engagement with the back surface of the child's seat, said step of positioning the cushion in the child's seat includes positioning a first one of the cushion legs along and in engagement with a first one of the side walls of the child's seat, said step of positioning a first one of the cushion legs includes positioning a portion of the first one of the cushion legs disposed between the bend in the first one of the cushion legs and the base portion of the cushion in engagement with the back surface of the child's seat and positioning a portion of the first one of the cushion legs disposed between the bend in the first one of the cushion legs and an axial end portion of the first one of the cushion legs in engagement with the seat surface of the child's seat, said step of positioning the cushion in the child's seat includes positioning a second one of the cushion legs extending from the base portion of the cushion along and in engagement with a second one of the side walls of the child's seat, said step of positioning a second one of the cushion legs includes positioning a portion of the second one of the cushion legs disposed between the bend in the second one of the cushion legs and the base portion of the cushion in engagement with the back surface of the child's seat and positioning a portion of the second one of the cushion legs disposed between the bend in the second one of the cushion legs and an axial end portion of the second one of the cushion legs in engagement with the seat surface of the child's seat, and placing the infant into the child's seat with lateral sides and top of the head of the infant at least partially enclosed by the base portion of the cushion and with hips and legs of the infant at least partially disposed between the first and second cushion legs and with the hips of the infant adjacent to the bends in the first and second cushion legs to reduce surface area of the child's seat for the infant to occupy in order to help minimizing of slouching of the infant in the child's seat.

26. An apparatus comprising:

a child's seat having first and second side walls with a seat surface extending between said first and second side walls and a back surface extending between said first and second side walls, and a unitary cushion having an upside down U-shaped structure with a base portion which extends between two legs of said cushion, each of said cushion legs having a central portion with a pre-shaped bend formed therein at a location which is approximately half of the length of the legs, said base portion of said cushion being disposed in engagement with said back surface of said child's seat, said base portion of said cushion being adapted to at least partially enclose lateral sides and top of a head of an infant disposed in the child's seat, said first leg of said cushion having a first portion which extends between the bend in said first leg of said cushion and said base portion of said cushion, said first portion of said first leg of said cushion is at least partially disposed in engagement with said back surface and said first side wall of said child's seat, said first leg of said cushion having a second portion which extends between the bend in said first leg of said cushion and an axial end portion of said first leg of said cushion, said second portion of said first leg extending in collinear alignment with said first portion at an angle between 90 degrees and 135 degrees, said second portion of said first leg of said cushion is at least partially disposed in engagement with said seat surface and said first side wall of said child's seat, said second leg of said cushion having a first portion which extends between the bend in said second leg of said cushion and said base portion of said cushion, said first portion of said second leg of said cushion is at least partially disposed in engagement with said back surface and said second side wall of said child's seat, said second leg of said cushion having a second portion which extends between the bend in said second leg of said cushion and an axial end portion of said second leg of said cushion, said second portion of said second leg extending in collinear alignment with said first portion at an angle between 90 degrees and 135 degrees, said second portion of said second cushion is at least partially disposed in engagement with said seat surface and said second side wall of said child's seat, said bends in said first and second legs of said cushion being disposed adjacent to hips of the infant disposed in the child's seat.

* * * * *